US007762161B2

(12) United States Patent
Lai

(10) Patent No.: US 7,762,161 B2
(45) Date of Patent: Jul. 27, 2010

(54) RATCHET SCREWDRIVER

(76) Inventor: Jin-Tsai Lai, P.O. Box 70-121 Taichung, Taichung City (TW) 40899

( * ) Notice: Subject to any disclaimer, the term of this patent is extended or adjusted under 35 U.S.C. 154(b) by 0 days.

(21) Appl. No.: 12/171,255

(22) Filed: Jul. 10, 2008

(65) Prior Publication Data

US 2010/0005931 A1 Jan. 14, 2010

(51) Int. Cl.
*B25B 13/46* (2006.01)

(52) U.S. Cl. ..... 81/63.1; 81/58.3

(58) Field of Classification Search ..... 81/60–62, 81/63.1, 58.3, 177.2, 177.85
See application file for complete search history.

(56) References Cited

U.S. PATENT DOCUMENTS 5,836,223 A * 11/1998 Lin ..... 81/436
6,186,031 B1 * 2/2001 Shiao ..... 81/63.1
6,314,838 B2 * 11/2001 Wall ..... 81/58.4
6,330,843 B1 * 12/2001 Lin ..... 81/63.1
6,450,312 B1 * 9/2002 Hsiao ..... 192/43.2
7,028,587 B1 * 4/2006 Chiang ..... 81/63.1
7,467,575 B2 * 12/2008 Lai ..... 81/177.1

* cited by examiner

*Primary Examiner*—David B Thomas

(57) ABSTRACT

A ratchet screwdriver includes a handle having a hole co-axially defined in the handle. A ratchet mechanism is co-axially received in the hole in the handle and comprises a ratchet wheel for driving the ratchet screwdriver with bi-directional operating and a selector for selectively determining the operational direction of the ratchet wheel. A driving shaft is relatively and co-axially mounted in the ratchet mechanism and ratchetly and bi-directionally driven by the ratchet wheel.

18 Claims, 10 Drawing Sheets

RATCHET SCREWDRIVER

BACKGROUND OF THE INVENTION

1. Field of the Invention

The present invention relates to a screwdriver, and more particularly to a ratchet screwdriver.

2. Description of Related Art

A conventional ratchet screwdriver includes a housing. A pinion rotatably is engaged in the housing. A sleeve is rotatably engaged on the housing and engaged with the pinion in order to rotate the pinion. A shaft rotatably is received in the housing. A notch is formed in the shaft for receiving a pawl. A rod has a gear engaged with the pinion and having a projection for engaging with the pawl in order to rotate the pawl. The pawl is rotated when the rod is rotated by the sleeve via the pinion.

The pawl of conventional ratchet screwdriver includes two ends each having a series of teeth formed therein. The inner periphery of the housing has a series of teeth radially formed therein and engaged by the two ends of the pawl. However, the pawl of the conventional ratchet screwdriver supports a torque of the rod and the shaft when the rod is rotated. Consequently, a torque of the whole conventional screwdriver for driving a workpiece is also centralized to the pawl when the conventional screwdriver is operated. Therefore, the pawl is not strong enough to support the torque of the whole conventional screwdriver and easily broken/deformed.

The present invention has arisen to mitigate and/or obviate the disadvantages of the conventional ratchet screwdriver.

SUMMARY OF THE INVENTION

The main objective of the present invention is to provide an improved ratchet screwdriver, which has a ratchet mechanism supporting a torque of the ratchet screwdriver and providing a bi-directional operating.

To achieve the objective, the ratchet screwdriver in accordance with the present invention comprises a handle having a hole co-axially defined therein. A ratchet mechanism is co-axially received in the hole in the handle and comprises a ratchet wheel for driving the ratchet screwdriver with bi-directional operating and a selector for selectively determining the operational direction of the ratchet wheel. A driving shaft is relatively and co-axially mounted in the ratchet mechanism and ratchetly and bi-directionally driven by the ratchet wheel.

Wherein, the ratchet mechanism according to the present invention includes a selector having a first pawl and a second pawl for engaging a ratchet wheel. The ratchet wheel has a first series of teeth partially corresponding to the first pawl and a second series of teeth partially corresponding to the second pawl. The first pawl supports a torque of the ratchet screwdriver when the ratchet screwdriver is clockwisely operated and the second pawl supports a torque of the ratchet screwdriver when the ratchet screwdriver is anticlockwisely operated. Therefore, the first pawl and the second pawl respectively support half power of the torque of the ratchet screwdriver when the ratchet screwdriver is bi-directional operated to provide less contact and less friction between the selector and the ratchet wheel for longer operation life.

Further benefits and advantages of the present invention will become apparent after a careful reading of the detailed description with appropriate reference to the accompanying drawings.

DETAILED DESCRIPTION OF THE INVENTION

Figure 1:
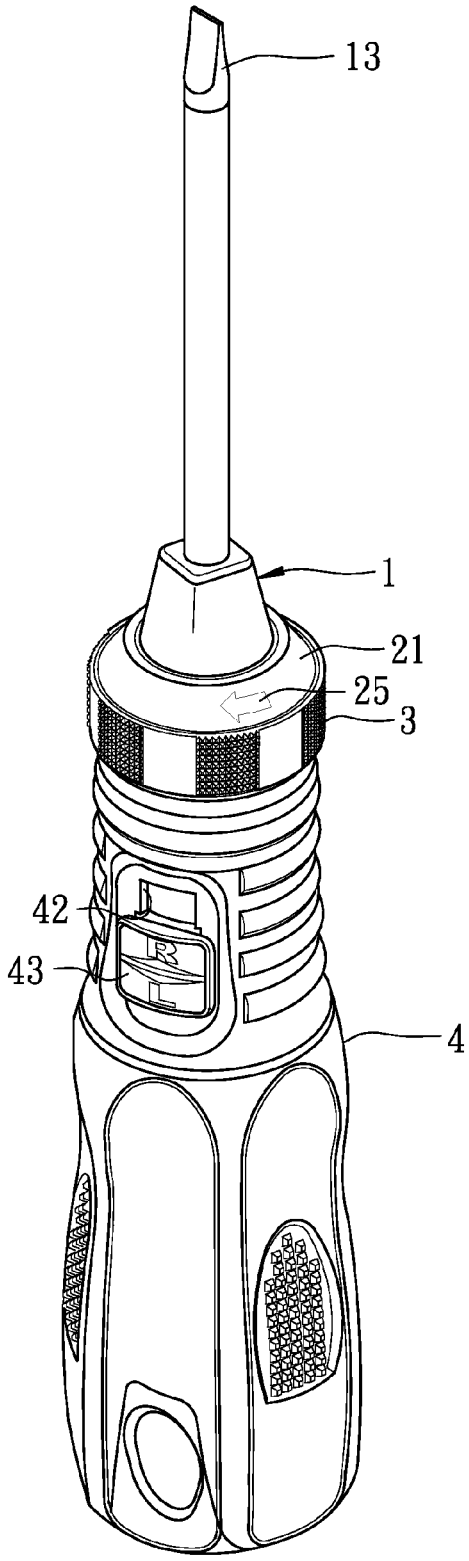
FIG. 1 is a perspective view of a ratchet screwdriver in accordance with the present invention.
Figure 2:
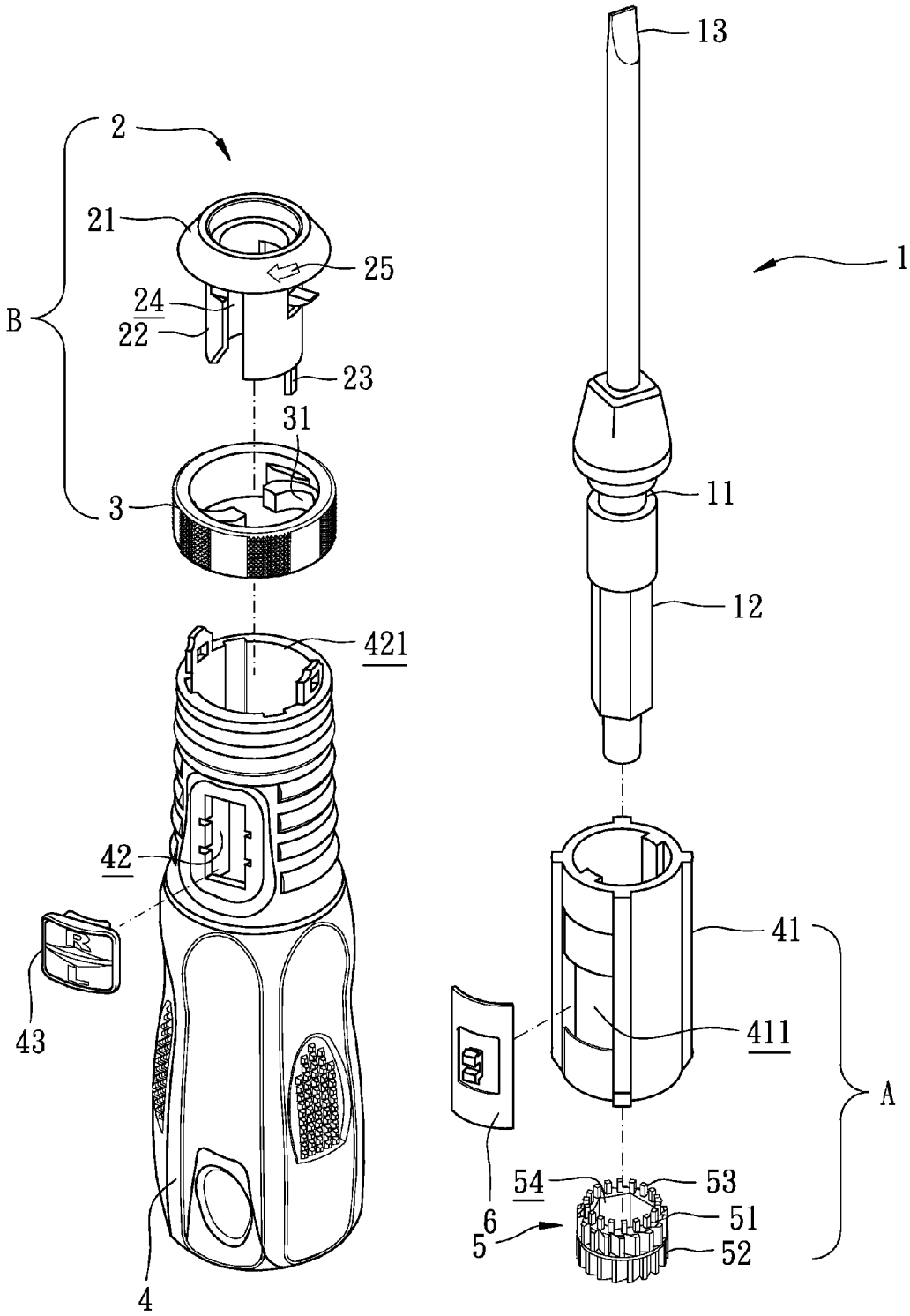
FIG. 2 is an exploded perspective view of the ratchet screwdriver in FIG. 1.
Figure 2A:
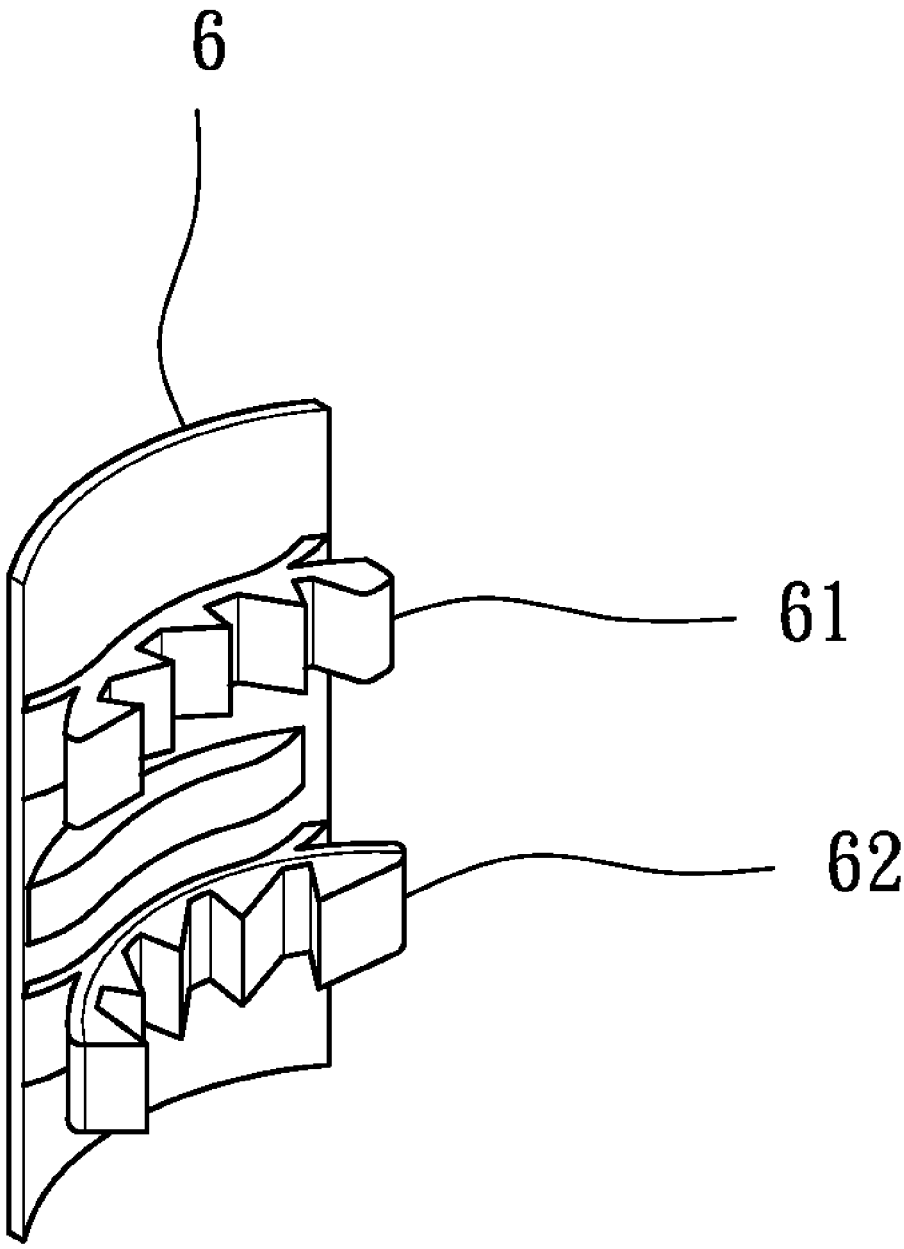
FIG. 2A is perspective view of a selector of the ratchet screwdriver in another direction.
Figure 3:
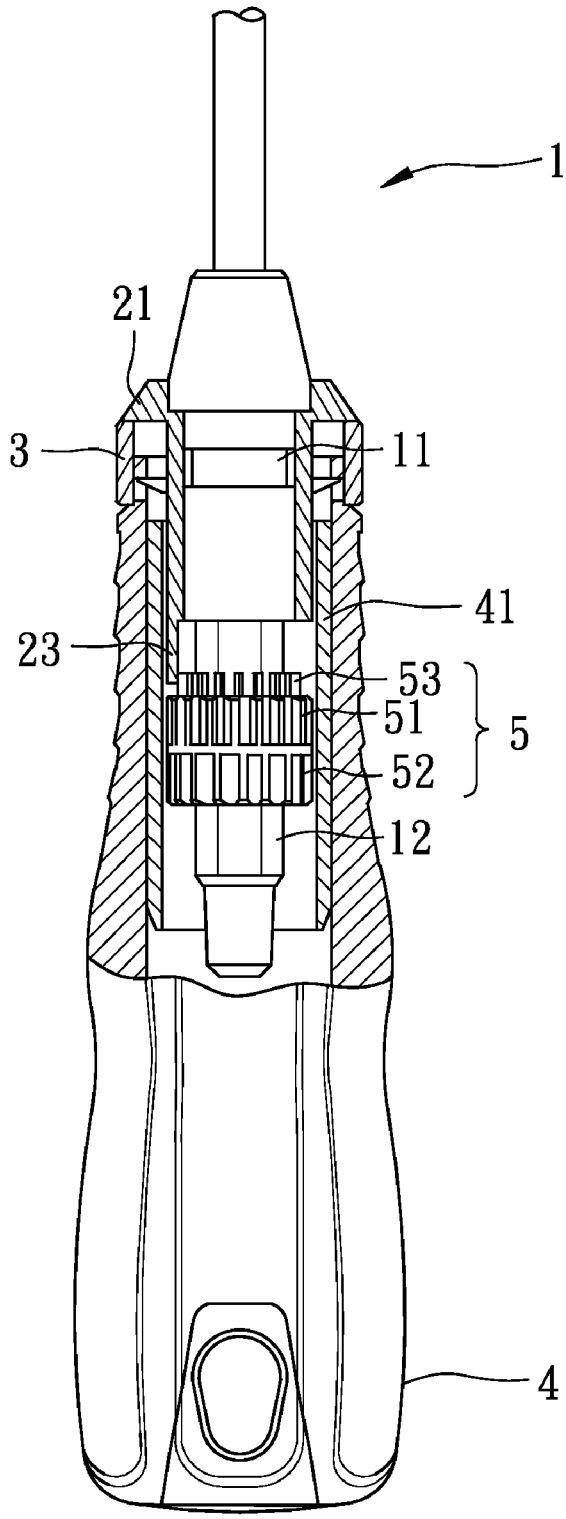
FIG. 3 is a side plan view of the ratchet screwdriver in FIG. 1 in partial cross-section.

Referring to the drawings and initially to FIGS. 1-3, a ratchet screwdriver in accordance with the present invention comprises a handle (4) having a hole (421) co-axially defined in the handle (4). In the preferred embodiment of the present invention, the handle (4) is made of insulated material. A ratchet mechanism (A) is co-axially received in the hole (421) of the handle (4) for determine a bi-directional operation of the ratchet screwdriver. In the preferred embodiment of the present invention, the ratchet mechanism (A) is made of insulated material. A driving shaft (1) is partially and co-axially inserted into the ratchet mechanism (A) and ratchetly and bi-directionally driven by the ratchet mechanism (A). A locking mechanism (B) is longitudinally and partially mounted into the hole (421) of the handle (4) for preventing the driving shaft (1) and the ratchet mechanism (A) from detaching from the hole (421) in the handle (4). In the preferred embodiment of the present invention, the locking mechanism (B) is made of insulated material.

The ratchet mechanism (A) comprises a hollow housing (41), a ratchet wheel (5) and a selector (6). The housing (41) is longitudinally received in the hole (421) in the handle and the ratchet wheel (5) is co-axially and rotatably received in the hollow housing (41). The ratchet wheel (5) has a polygonal hole (54) centrally defined therein and extending therethrough. In the preferred embodiment of the present invention, the polygonal hole (54) of the ratchet wheel (5) is a hexagonal hole. An outer periphery of the ratchet wheel (5) has a first series of teeth (51) and a second series of teeth (52) radially and concentrically formed thereon. A slant angle of the first series of teeth (51) is opposite to that of the second series of teeth (52). A series of stubs (53) is longitudinally extending from an upper end of the ratchet wheel (5) and engaged with the locking mechanism (B). The hollow housing (41) has a slot (411) defined in an outer periphery thereof and communicating with an inner periphery of the hollow housing (41) for partially and movably receiving the selector (6) such that the selector (6) is longitudinally moved within the slot (411). The selector (6) has an inner surface formed thereon. A first pawl (61) is formed on the inner surface of the selector (6) for selectively engaged to the first series of teeth (51) and a second pawl (62) is formed on the inner surface of the selector (6) for selectively engaged to the second series of teeth (52) for determining the operational direction of the ratchet screwdriver when the selector (6) is moved within the slot (411). The ratchet wheel (5) is received in the hollowing housing (41) from a lower end thereof and maintained in the middle section of hollow housing (41) for connecting to the selector (6).

The locking mechanism (B) comprises a hollow holder (2) and a locking ring (3). The locking ring (3) is longitudinally mounted on the handle (4) and has two flexible arms (31) inwardly vertically extending from an inner periphery thereof and diametrically corresponding to each other. The holder (2) extends through the locking ring (3) and is longitudinally and partially mounted in the hole (421) of the handle (4). The holder (2) has two aprons (22) longitudinally extending from a lower end thereof and received in the hole (421) in the handle (4). The two aprons (22) diametrically correspond to each other and define two grooves (24). The two flexible arms (31) of the locking ring (3) respectively extend through a corresponding one of the two grooves (24) for selectively locking the driving shaft (1). The holder (2) has a tapped flange (21) formed on an upper end thereof and an outer diameter of the tapped flange (21) is greater than an inner diameter of the locking ring (3) for preventing the locking ring (3) from detaching from the handle (4). An indicator (25) is disposed on the tapped flange (21) for indicating an operating direction of the locking ring (3). One of the two aprons (22) of the holder (4) has a protrusion (23) longitudinally extending therefrom for connecting to the series of stubs (53) of the ratchet wheel (5) and making click sound when the protrusion (23) flexibly moves over a corresponding one of the series of stubs (53). The handle (4) has an aperture (42) laterally defined therein and communicating with the slot (411) of the hollow housing (41) when the ratchet mechanism (A) is received in the hole (421) of the handle (4). A button (43) is mounted to an outer surface of the selector (6) via the aperture (42) in the handle (4) for synchronously driving the selector (6).

The driving shaft (1) has a polygonal end (12) formed on one end thereof and complementally received in the polygonal hole (54) in the ratchet wheel (5), and co-axially and synchronously driven by the ratchet wheel (5) after assembling. The driving shaft (1) has a driving end (13) formed on the other end thereof for co-axially driving a workpiece (not shown). A neck (11) is formed between the driving end (13) and the polygonal end (12). In the preferred embodiment of the present invention, besides the driving end (13), the driving shaft (1) is made of isolated insulated material. The two flexible arms (31) of the locking ring (3) are selectively engaged to the neck (11) for preventing the driving shaft (1) form detaching from the handle (4) when the polygonal end (12) of the driving shaft (1) is complementally received in the polygonal hole (54) in the ratchet wheel (5).

Figure 4:
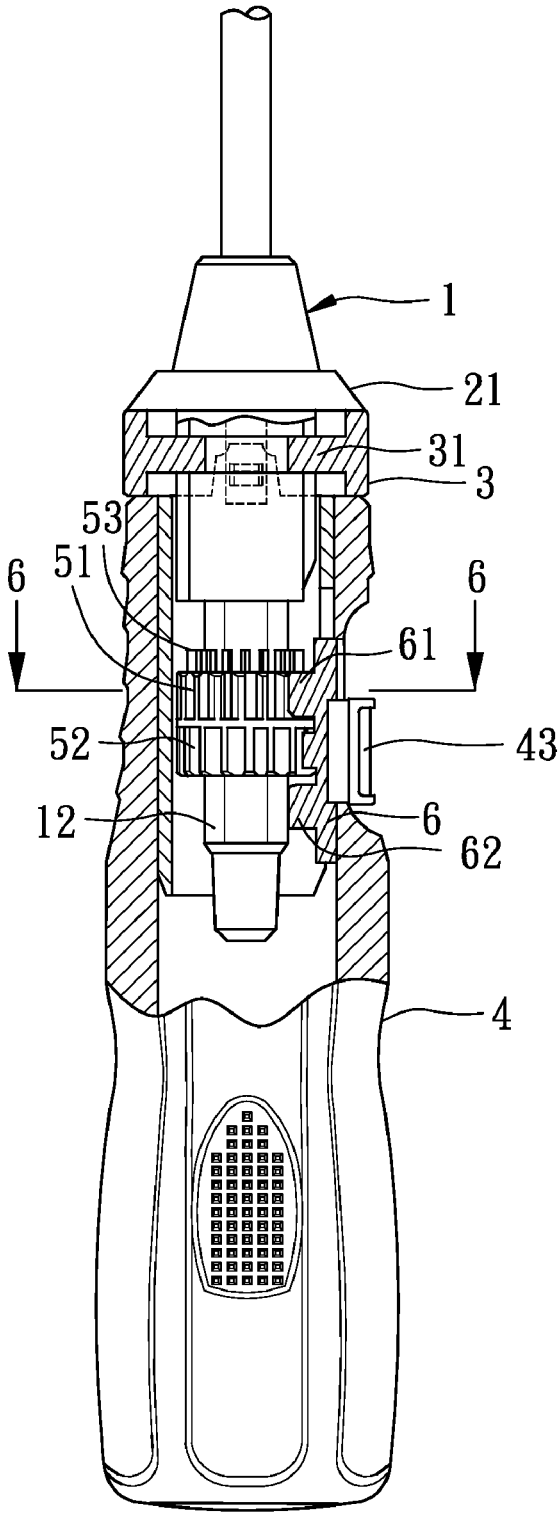
FIG. 4 and FIG. 5 are operational views of the ratchet screwdriver in accordance with the present invention for changing the operational direction.
Figure 5:
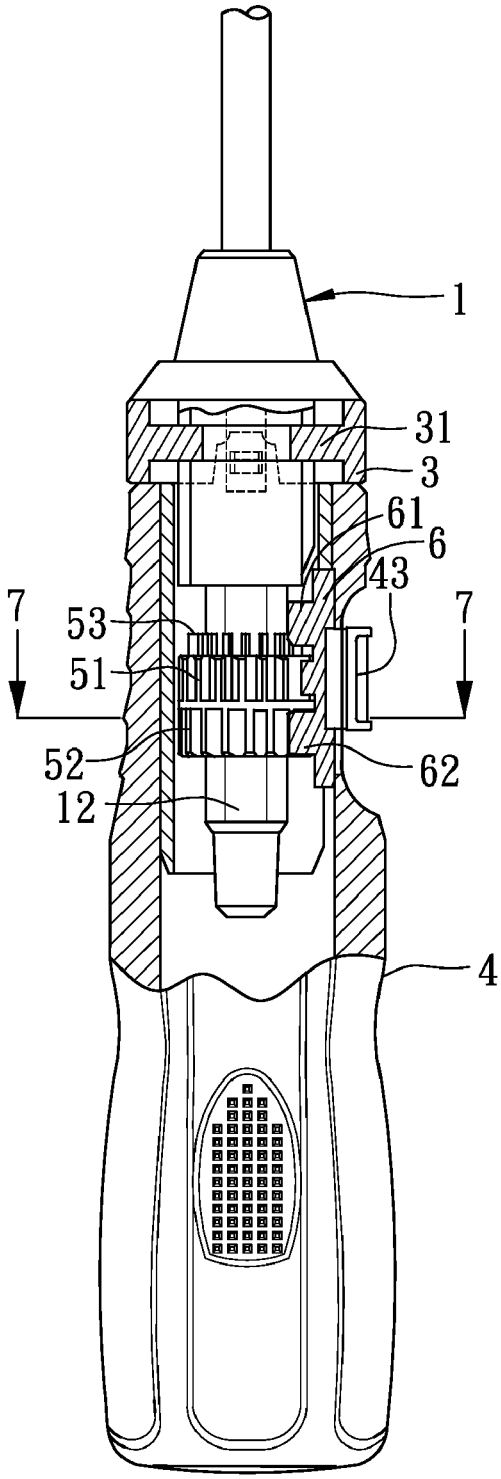
Figure 6:
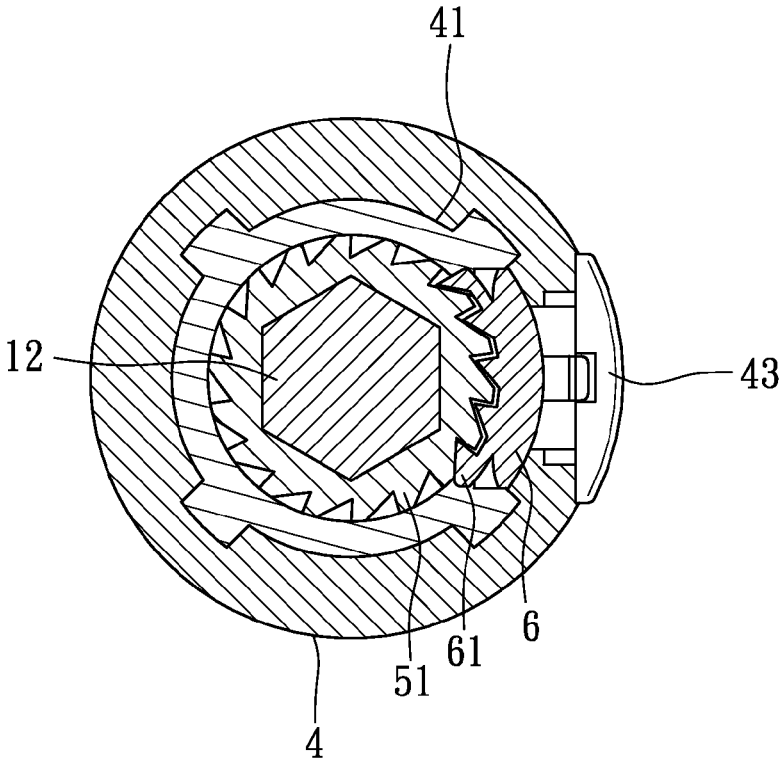
FIG. 6 is a top cross-sectional view of the ratchet screwdriver of the present invention along line 6-6 in FIG. 4.
Figure 7:
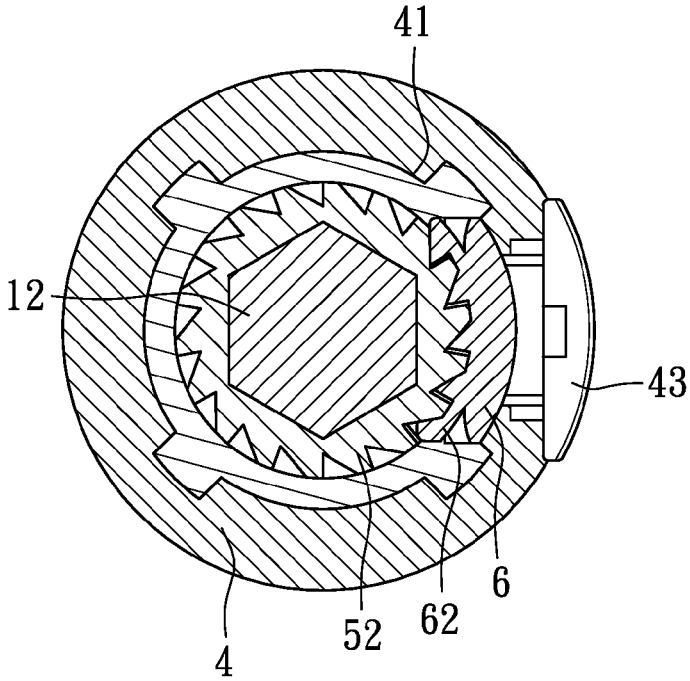
FIG. 7 is a top cross-sectional view of the ratchet screwdriver of the present invention along line 7-7 in FIG. 5.

With reference to FIG. 4 to FIG. 7 that show the operation of the ratchet mechanism (A). As shown in FIGS. 4 and 6, the first pawl (61) of the selector (6) engages to the first series of teeth (51) of the ratchet wheel (5) and the second pawl (62) of the selector (6) is detached from the second series of teeth (52) when the selector (6) is downwardly moved such that the ratchet screwdriver is restrictedly for clockwisely driving the driving shaft (1). As shown in FIGS. 5 and 7, the second pawl (62) of the selector (6) engages to the second series of teeth (52) of the ratchet wheel (5) and the first pawl (61) of the selector (6) is detached from the first series of teeth (51) when the selector (5) is downwardly moved such that the ratchet screwdriver is restrictedly for anticlockwisely driving the driving shaft (1).

Figure 8:
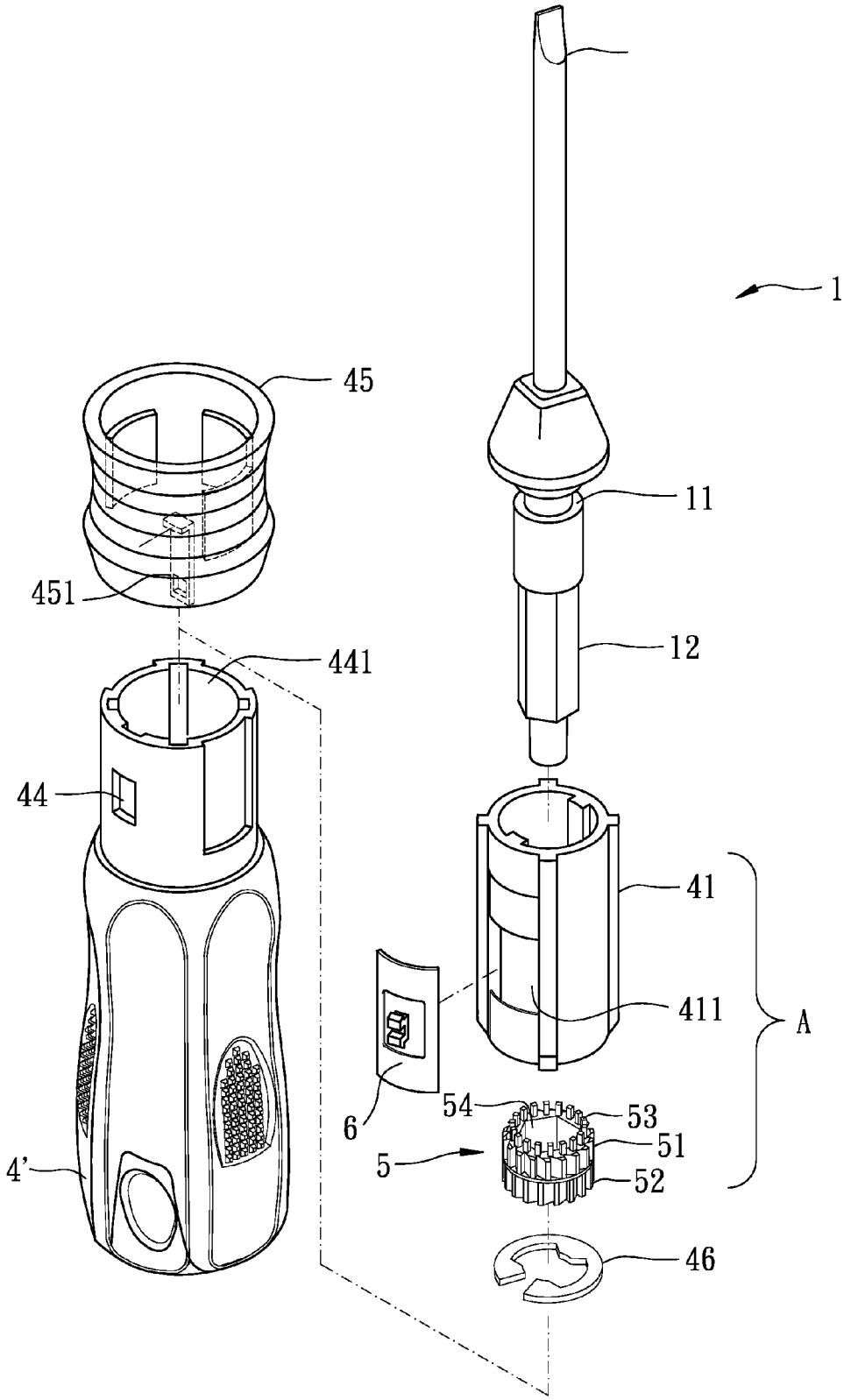
FIG. 8 is an exploded perspective view of a second embodiment of the ratchet screwdriver in accordance with the present invention.
Figure 9:
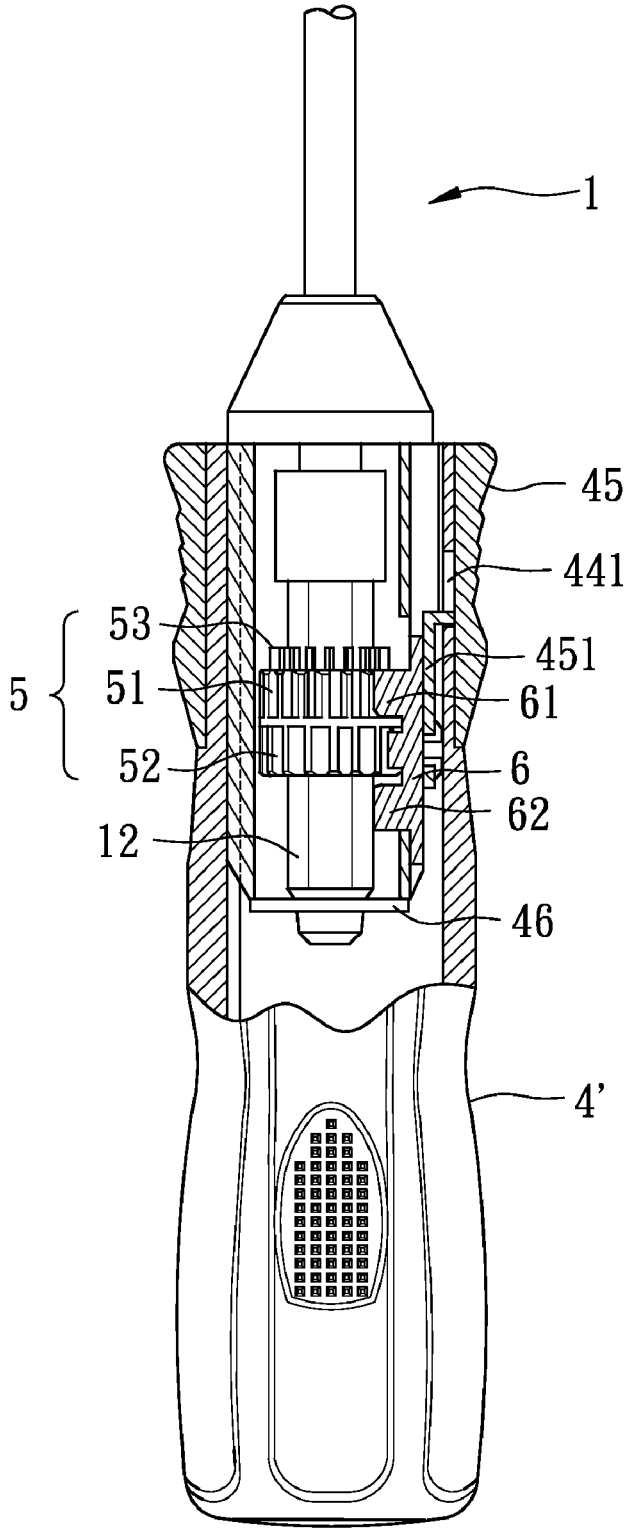
FIG. 9 and FIG. 10 are operational views of the ratchet screwdriver in FIG. 8 when changing the operational direction thereof.
Figure 10:
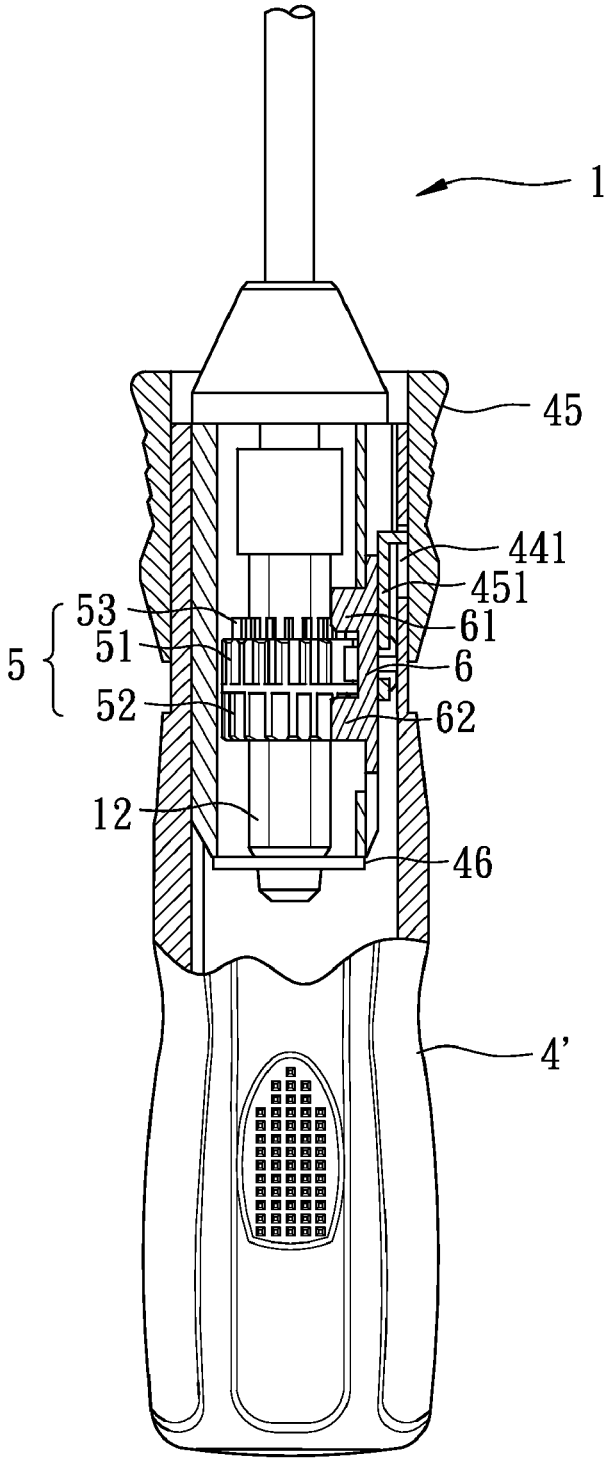

With reference to FIGS. 8 to 10 that show a second embodiment of the ratchet screwdriver in accordance with the present invention, as shown in FIG. 8, in this embodiment, the handle (4) and the locking mechanism (B), hereinbefore, are replaced by a handle (4') and a sleeve (45). The handle (4') has a hole (441) co-axially defined therein for receiving the ratchet mechanism (A). An aperture (44) is laterally defined in the handle (4') and communicating with the hole (411). The sleeve (45) is longitudinally movably sleeved on the handle (4'). A stick (451) is laterally mounted on an inner periphery of the sleeve (45) via the aperture (44) and extends downward for connecting to the outer surface of the selector (6) for synchronously driving the selector (6) when the ratchet mechanism (A) is received in the hole (441) and the sleeve (45) is longitudinally sleeved on the handle (4'). A clip (46) is fixed on the distal end of the driving shaft (1) for preventing the driving shaft (1) form detaching from the polygonal hole (54) of the ratchet wheel (5). As shown in FIG. 9, the first pawl (61) of the selector (6) engages to the first series of teeth (51) of the ratchet wheel (5) and the second pawl (62) of the selector (6) is detached from the second series of teeth (52) when the sleeve (45) is downwardly slidably moved and the selector (6) is synchronously driven by the sleeve (45) such that the ratchet screwdriver restrictedly and colckwisely drives the driving shaft (1). As shown in FIG. 10, the second pawl (62) of the selector (6) engages to the second series of teeth (52) of the ratchet wheel (5) and the first pawl (61) of the selector (6) is detached from the first series of teeth (51) when the sleeve (45) is upwardly slidingly moved and the selector (6) is synchronously driven by the sleeve (45) such the ratchet screwdriver is restrictedly and anticlockwisely drives the driving shaft (1).

Although the invention has been explained in relation to its preferred embodiment, it is to be understood that many other possible modifications and variations can be made without departing from the spirit and scope of the invention as hereinafter claimed.

What is claimed is:

1. A ratchet screwdriver comprising:

a handle having a hole co-axially defined therein; a ratchet mechanism co-axially received in the hole in the handle and comprising a ratchet wheel for driving the ratchet screwdriver with bi-directional operations, and a selector mounted on the ratchet mechanism and engaging with the ratchet wheel for selectively determining the operational direction of the ratchet wheel; a driving shaft relatively and co-axially mounted in the ratchet mechanism, and ratchetly and bi-directionally driven by the ratchet wheel; and a locking mechanism made of insulated material and partially longitudinally mounted in the hole in the handle for preventing the driving shaft from detaching from the ratchet screwdriver, the locking mechanism having a protrusion longitudinally extending therefrom for engaging the ratchet wheel, the ratchet wheel having a series of stubs longitudinally extending therefrom and engaged by the protrusion for making click sound when the protrusion flexibly moves over a corresponding one of the series of stubs.

2. The ratchet screwdriver as claimed in claim 1, wherein the ratchet mechanism comprises a hollow housing longitudinally and fixedly received in the hole in the handle, the ratchet wheel co-axially and rotatably received in the hollow housing and having a polygonal hole co-axially defined therethrough for partially receiving the driving shaft, the driving shaft made of insulated material and having a polygonal end inserted into the polygonal hole in the ratchet wheel and synchronously driven by the ratchet wheel after assembling.

3. The ratchet screwdriver as claimed in claim 2, wherein the hollow housing has a slot defined in an outer periphery thereof and communicating with an inner periphery of the hollow housing, the selector partially and movably received in the slot for selectively determining a rotating direction of the ratchet wheel.

4. The ratchet screwdriver as claimed in claim 3, wherein the ratchet wheel has a first series of teeth and a second series of teeth laterally radially and concentrically formed on an outer periphery of the ratchet wheel, the selector having a first pawl formed on an inner surface of the selector for corresponding to the first series of teeth and a second pawl formed on the inner surface of the selector for corresponding to the second series of teeth; whereby the ratchet screwdriver is operated in clockwise for clockwisely driving the driving shaft when the second pawl of the selector engages with the second series of teeth of the ratchet wheel, and the ratchet screwdriver is operated with anticlockwise for anticlockwisely driving the driving shaft when the first pawl of the selector engages with the first series of teeth of the ratchet wheel.

5. The ratchet screwdriver as claimed in claim 4, wherein the locking mechanism has a hollow holder and a locking ring, the locking ring longitudinally mounted on the handle and having two flexible arms inwardly extending from an inner periphery of the locking ring and diametrically corresponding to each other, the holder extending through the locking ring and longitudinally partially mounted in the hole in the handle, the holder having two aprons longitudinally extending from a lower end thereof and received in the hole in the handle, the two aprons diametrically corresponding to each other to define two grooves, the two flexible arms of the locking ring respectively extending through a corresponding one of the two grooves for selectively locking the driving shaft, the driving shaft having a neck formed thereon and laterally engaged by the two arms for preventing the driving shaft form detaching from the handle when the neck of the driving shaft is diametrically aligned with the two arms of the locking ring.

6. The ratchet screwdriver as claimed in claim 5, wherein the holder having a tapped flange formed on an upper end thereof, an indicator disposed on the tapped flange for indicating an operating direction of the locking ring.

7. The ratchet screwdriver as claimed in claim 5, wherein the protrusion is longitudinally extended from one of the two aprons for engaging the ratchet wheel.

8. The ratchet screwdriver as claimed in claim 4 further comprising a sleeve movably and longitudinally mounted on the handle, the handle having an aperture laterally defined therein and communicating with the slot of the hollow housing, a stick mounted on an inner periphery of the sleeve via the aperture to connect to the selector for synchronously driving the selector when the sleeve is longitudinally mounted on the handle and the ratchet mechanism is received in the hole.

9. The ratchet screwdriver as claimed in claim 8 further comprising a clip fixed on the distal end of the driving shaft for preventing the driving shaft form detaching from the polygonal hole in the ratchet wheel.

10. The ratchet screwdriver as claimed in claim 3, wherein the handle is made of insulated material, an aperture laterally defined in the handle communicating with the slot of the hollow housing when the ratchet mechanism is received in the hole in the handle, a button mounted to an outer surface of the selector via the aperture in the handle for synchronously driving the selector.

11. The ratchet screwdriver as claimed in claim 3 further comprising a sleeve movably and longitudinally mounted on the handle, the handle having an aperture laterally defined therein and communicating with the slot of the hollow housing, a stick mounted on an inner periphery of the sleeve via the aperture to connect to the selector for synchronously driving the selector when the sleeve is longitudinally mounted on the handle and the ratchet mechanism is received in the hole.

12. The ratchet screwdriver as claimed in claim 11 further comprising a clip fixed on the distal end of the driving shaft for preventing the driving shaft form detaching from the polygonal hole in the ratchet wheel.

13. The ratchet screwdriver as claimed in claim 2, wherein the locking mechanism has a hollow holder and a locking ring, the locking ring longitudinally mounted on the handle and having two flexible arms inwardly extending from an inner periphery of the locking ring and diametrically corresponding to each other, the holder extending through the locking ring and longitudinally partially mounted in the hole in the handle, the holder having two aprons longitudinally extending from a lower end thereof and received in the hole in the handle, the two aprons diametrically corresponding to each other to define two grooves, the two flexible arms of the locking ring respectively extending through a corresponding one of the two grooves for selectively locking the driving shaft, the driving shaft having a neck formed thereon and laterally engaged by the two arms for preventing the driving shaft form detaching from the handle when the neck of the driving shaft is diametrically aligned with the two arms of the locking ring.

14. The ratchet screwdriver as claimed in claim 13, wherein the holder having a tapped flange formed on an upper end thereof, an indicator disposed on the tapped flange for indicating an operating direction of the locking ring.

15. The ratchet screwdriver as claimed in claim 13, wherein the protrusion is longitudinally extended from one of the two aprons for engaging the ratchet wheel.

16. The ratchet screwdriver as claimed in claim 1, wherein the locking mechanism has a hollow holder and a locking ring, the locking ring longitudinally mounted on the handle and having two flexible arms inwardly extending from an inner periphery of the locking ring and diametrically corresponding to each other, the holder extending through the locking ring and longitudinally partially mounted in the hole in the handle, the holder having two aprons longitudinally extending from a lower end thereof and received in the hole in the handle, the two aprons diametrically corresponding to each other to define two grooves, the two flexible arms of the locking ring respectively extending through a corresponding one of the two grooves for selectively locking the driving shaft, the driving shaft having a neck formed thereon and laterally engaged by the two arms for preventing the driving shaft form detaching from the handle when the neck of the driving shaft is diametrically aligned with the two arms of the locking ring.

17. The ratchet screwdriver as claimed in claim 16, wherein the holder having a tapped flange formed on an upper end thereof, an indicator disposed on the tapped flange for indicating an operating direction of the locking ring.

18. The ratchet screwdriver as claimed in claim 16, wherein the protrusion is longitudinally extended from one of the two aprons for engaging the ratchet wheel.

* * * * *